US010358695B2

(12) United States Patent
Walker et al.

(10) Patent No.: US 10,358,695 B2
(45) Date of Patent: Jul. 23, 2019

(54) METHODS TO INCREASE SOLID SOLUTION ZIRCONIUM IN ALUMINUM ALLOYS

(71) Applicant: GM Global Technology Operations LLC, Detroit, MI (US)

(72) Inventors: Michael J. Walker, Shelby Township, MI (US); Qigui Wang, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 112 days.

(21) Appl. No.: 15/481,666

(22) Filed: Apr. 7, 2017

(65) Prior Publication Data

US 2018/0291479 A1 Oct. 11, 2018

(51) Int. Cl.
*C22C 1/02* (2006.01)
*C22C 21/00* (2006.01)
(Continued)

(52) U.S. Cl.
CPC ..... *C22C 1/026* (2013.01); *C22C 1/03* (2013.01); *C22C 9/00* (2013.01); *C22C 16/00* (2013.01);
(Continued)

(58) Field of Classification Search
CPC ..... C22C 1/026; C22C 21/00; C22C 1/03; C22C 45/08; C22C 45/001; C22C 45/00
See application file for complete search history.

(56) References Cited

U.S. PATENT DOCUMENTS 3,190,750 A 6/1965 Staggers et al.
3,307,857 A 3/1967 Conant
(Continued)

FOREIGN PATENT DOCUMENTS

CN 103111609 A * 5/2013
CN 103111609 A 5/2013
(Continued)

OTHER PUBLICATIONS

Guo, Zhanying, Gang Zhao & X.-Grant Chen. "Effects of two=step homogenization on precipitation behavior of Al3Zr dispersoids and recrystallization resistance in 7150 aluminum alloy." Materials Characterization.102 pp. 122-130. http://dx.doi.org/10.1016/j.matchar.2015.02.016 (Year: 2015).*
(Continued)

*Primary Examiner* — Tima M. McGuthry-Banks
(74) *Attorney, Agent, or Firm* — Harness, Dickey & Pierce, P.L.C.

(57) ABSTRACT

A method of making an aluminum alloy containing zirconium includes heating a first composition comprising aluminum to a first temperature of greater than or equal to about 580° C. to less than or equal to about 800° C. The method further includes adding a second composition including a copper-zirconium compound to the first composition to form a third composition. The copper-zirconium compound of the second composition has a molar composition of greater than or equal to about 41% zirconium to less than or equal to about 67% zirconium and a balance of copper. The method also includes solidifying the third composition at a cooling rate of greater than or equal to about 0.1° C./second to less than or equal to about 100° C./second to a second temperature less than or equal to a solidus temperature and decomposing the copper-zirconium compound at a third temperature of less than or equal to about 715° C.

14 Claims, 3 Drawing Sheets

(51) Int. Cl.

| | |
|---|---|
| ***C22C 45/00*** | (2006.01) |
| ***C22C 45/08*** | (2006.01) |
| ***C22C 1/03*** | (2006.01) |
| ***C22C 9/00*** | (2006.01) |
| ***C22F 1/04*** | (2006.01) |
| ***C22C 16/00*** | (2006.01) |

(52) U.S. Cl.
CPC ..... *C22C 21/00* (2013.01); *C22C 45/00* (2013.01); *C22C 45/001* (2013.01); *C22C 45/08* (2013.01); *C22F 1/04* (2013.01)

(56) References Cited

U.S. PATENT DOCUMENTS

| | | | | |
|---|---|---|---|---|
| 3,462,248 | A | 8/1969 | Roberts et al. | |
| 3,694,195 | A | 9/1972 | Yokota | |
| 3,933,476 | A | 1/1976 | Chopra et al. | |
| 4,063,936 | A | 12/1977 | Nagase et al. | |
| 5,135,582 | A | 8/1992 | Mochizuki et al. | |
| 6,123,899 | A | 9/2000 | Setzer et al. | |
| 6,202,618 | B1 | 3/2001 | Baxter et al. | |
| 6,543,405 | B2 | 4/2003 | Sachdev et al. | |
| 6,945,214 | B2 | 9/2005 | Sachdev et al. | |
| 7,938,058 | B2 | 5/2011 | Becker et al. | |
| 9,339,990 | B2 | 5/2016 | Jang et al. | |
| 9,533,351 | B2 | 1/2017 | Bishop et al. | |
| 2012/0087826 | A1* | 4/2012 | Senkov | C22C 21/10 420/532 |
| 2018/0010215 | A1* | 1/2018 | Sanaty-Zedah | C22C 1/02 |
| 2018/0291480 | A1 | 10/2018 | Walker et al. | |

FOREIGN PATENT DOCUMENTS

| | | | |
|---|---|---|---|
| CN | 108690918 | A | 10/2018 |
| DE | 102018107859 | A1 | 10/2018 |

OTHER PUBLICATIONS

Shi, Cangji, & X.-Grant Chen. "Effect of Zr addition on hot deformation behavior and microstructural evolution of AA7150 aluinum alloy." Materials Science & Engineering A. 596 pp. 183-193. http://dx.doi.org/10.1016/j.msea.2013.12.057 (Year: 2014).*

CN 103111609 A machine translation. (Year: 2013).*

Tretyachenko, Ludmila. "Aluminum-Copper-Zirconium." Ternary Alloy Systems. G. Effenberg (Ed). Subvolume A, Part 2. pp. 206-222. doi.org/10.1007/10915967_14 (Year: 2005).*

Shao, G. "Thermodynamic and kinetic aspects of intermetallic amorphous alloys." Intermetallics. vol. 11, pp. 313-324. doi: 10.1015/S0966-9795(02)00248-0 (Year: 2003).*

Zhou, Chenyang et al. "Thermodynamic assessment of the phase equilibria and prediction of glass-forming ability of the Al-Cu-Zr system." Journal of Non-Crystalline Solids 461. pp. 47-60. Available online Feb. 3, 2017. doi:org/10.1016/j.jnoncrysol.2016.09.031 Year: 2017).*

Wang, C.P. et al. "Experimental investigation of phase equilibria in the Zr-Cu-Al system." Intermetallics. vol. 31 pp. 1-8. doi: 10.1016/j.intermet.2012.04.014 (Year: 2012).*

Khan, Atta U. et al "Crystal Structure of novel compounds in the systems Zr-Cu-Al, Mo-Pd-Al and partial phase equilibria in the Mo-Pd-Al system." Dalton Transactions. vol. 41. pp. 2296-2303. doi: 10.1039/cldt11972a (Year: 2012).*

Campbell, Flake C. (ed) "Peritectic Alloy Systems." Phase Diagrams: Understanding the Basics. ASM International pp. 117-134 Year: 2012).*

Walker, Michael J. et al., U.S. Appl. No. 15/975,159, filed May 9, 2018 entitled "Methods to Increase Titanium in Aluminum Alloys," 63 pages.

Ito, Seitaro et al., "A synthesis of crystalline $Li_7P_3S_{11}$ solid electrolyte from 1,2-dimethoxyethane solvent," *Journal of Power Sources*, 271, (2014) 342-345.

Shaha, S.K. et al.; "Improving High-Temperature Tensile and Low-Cycle Fatigue Behavior of Al-Si-Cu-Mg Alloys Through Micro-additions of Ti, V, and Zr;" Metallurgical Transactions A; vol. 46, No. 5; Apr. 10, 2015; 16 pages.

"Copper-zirconium (CuZr) Master Alloy—Properties and Applications;" KBM Affilips; http://azom.com/article.aspx?ArticleID-10863; Apr. 3, 2014; 4 pages.

* cited by examiner

METHODS TO INCREASE SOLID SOLUTION ZIRCONIUM IN ALUMINUM ALLOYS

GOVERNMENT SUPPORT

This invention was made with government support under DE-EE0006082 awarded by the U.S. Department of Energy. The Government has certain rights in the invention.

INTRODUCTION

This section provides background information related to the present disclosure which is not necessarily prior art.

The present disclosure pertains to methods for increasing solid solution zirconium in aluminum alloys by the introduction and dissolution of Cu—Zr alloys and powders.

As background, components formed using aluminum alloys have become ever more prevalent in various industries and applications, including general manufacturing, construction equipment, automotive or other transportation industries, home or industrial structures, aerospace, and the like. For example, aluminum alloys are commonly used in manufacturing industries for castings, such as, for example, engine heads, engine blocks, transmission cases, and suspension components in the automobile industry. It is often desirable to increase thermal stability of aluminum alloys for elevated temperature applications by increasing solid state zirconium levels to improve microstructure and avoid degradation of mechanical properties of the alloy. However, zirconium generally has low solubility in various aluminum alloys, thus posing challenges with enhancing an amount of solid state zirconium in aluminum alloys.

SUMMARY

This section provides a general summary of the disclosure, and is not a comprehensive disclosure of its full scope or all of its features.

In certain aspects, a method of making an aluminum alloy containing zirconium is provided. The method includes heating a first composition comprising aluminum to a first temperature of greater than or equal to about 580° C. to less than or equal to about 800° C. The method further includes adding a second composition including a copper-zirconium compound to the first composition to form a third composition. The copper-zirconium compound of the second composition has a molar composition of greater than or equal to 41% zirconium to less than or equal to about 67% zirconium and a balance of copper. The method also includes solidifying the third composition at a cooling rate of greater than or equal to about 0.1° C./second to less than or equal to about 100° C./second to a second temperature less than or equal to a solidus temperature. The method also includes decomposing the copper-zirconium compound at a second temperature of less than or equal to about 715° C.

In some embodiments, the copper-zirconium compound includes CuZr.

In some embodiments, the method further includes dissolving at least some of the zirconium in the aluminum.

In some embodiments, the method further comprises heat treating the third composition to create the aluminum alloy containing zirconium. The heat treating facilitates formation of one or more precipitates as a distinct phase in the aluminum alloy containing zirconium.

In some embodiments, at least some of the precipitates comprise compounds of zirconium (Zr) and aluminum (Al).

In some embodiments, the precipitates have a dimension of less than or equal to about 500 micron (μm).

In some embodiments, the precipitates have a dimension of less than or equal to about 500 nanometers (nm).

In some embodiments, the heat treating includes heating the third composition to a fourth temperature of greater than or equal to a solvus temperature of the third composition to less than or equal to a solidus temperature of the third composition to form a solid solution. Heat treating also includes quenching the solid solution to a fifth temperature of greater than or equal to about 20° C. to less than or equal to about 300° C. to form a quenched solid solution. Heat treating also includes heating the quenched solid solution to a sixth temperature greater than the fifth temperature to create the aluminum alloy containing zirconium.

In some embodiments, the aluminum alloy containing zirconium includes a casting aluminum alloy selected from the group consisting of: 2xx series, 3xx series, 4xx series, 5xx series, 7xx series, and combinations thereof.

In some embodiments, the aluminum alloy containing zirconium includes a wrought aluminum alloy selected from the group consisting of: 2xxx series, 3xxx series, 4xxx series, 5xxx series, 6xxx series, 8xxx series, and combinations thereof.

In some embodiments, the aluminum alloy containing zirconium includes copper at greater than or equal to about 0.1% by mass to less than or equal to about 10% by mass and zirconium at greater than or equal to about 0.05% by mass to less than or equal to about 5% by mass.

In some embodiments, the aluminum alloy containing zirconium includes copper at greater than or equal to about 0.5% by mass to less than or equal to about 3% by mass.

In some embodiments, the aluminum alloy containing zirconium includes zirconium at greater than or equal to a liquid peritectic composition of zirconium in the aluminum alloy containing zirconium.

In some embodiments, the aluminum alloy containing zirconium includes an average grain size of greater than or equal to about 10 microns (μm) to less than or equal to about 10 centimeter (cm).

In some embodiments, the average grain size is greater than or equal to about 100 microns (μm) to less than or equal to about 500 microns (μm).

In certain other aspects, the present disclosure provides a method of making an aluminum alloy containing zirconium. The method includes adding a master alloy including a copper-zirconium compound to a melt including aluminum. The copper-zirconium compound has a molar composition of greater than or equal to about 41% zirconium in copper to less than or equal to about 67% zirconium in copper. The method also includes cooling the melt to a first temperature of less than or equal to about 715° C. The method also includes decomposing the copper-zirconium compound to form zirconium. The method also includes dissolving at least some of the zirconium from the decomposed copper-zirconium compound into the aluminum of the melt.

In some embodiments. Dissolving at least some of the zirconium includes dissolving less than or equal to a solid solubility of zirconium in the aluminum melt to form a solid solution.

In some embodiments, the copper-zirconium compound includes CuZr.

In still other aspects, the aluminum alloy containing zirconium includes a precipitate phase including compounds of zirconium (Zr) and (Al). The precipitate phase has a dimension of less than or equal to about 500 nanometers (nm). The aluminum alloy containing zirconium includes aluminum at least than or equal to about 99.82% by mass, copper at greater than or equal to about 0.1% by mass, and zirconium at greater than or equal to about 0.05% by mass.

In some embodiments, the aluminum alloy containing zirconium includes an average grain size of greater than or equal to about 10 microns (μm) to less than or equal to about 10 centimeter (cm).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
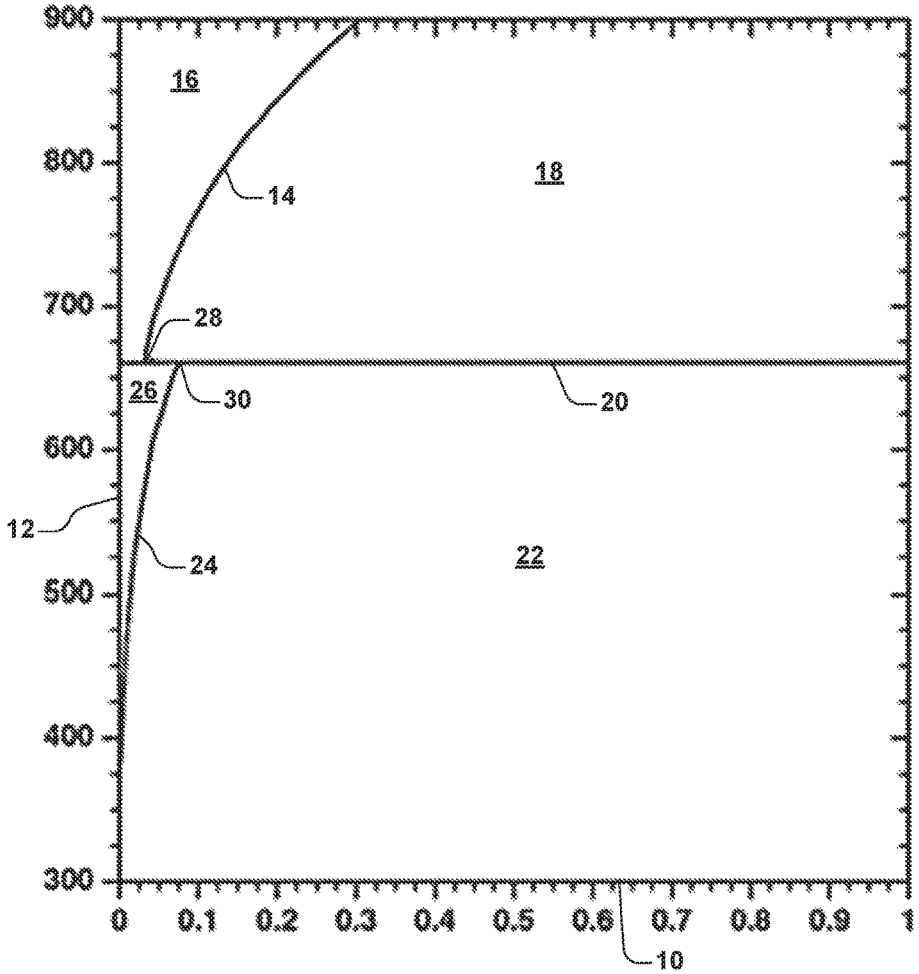
FIG. 1 is a partial binary phase diagram of an aluminum-zirconium system showing a peritectic transition at 660.8° C.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

Aluminum alloys are widely used in vehicles, such as automobiles, motorcycles, boats, tractors, buses, mobile homes, campers, and tanks, and their utilization will continue with efforts to reduce vehicle mass and save space. Methods of processing aluminum alloys according to the present technology form components with reduced mass relative to components made with traditional alloys, such as steel, while maintaining strength and ductility requirements. Aluminum alloys are particularly suitable for use in components of an automobile or other vehicles (e.g., motorcycles, boats), but may also be used in a variety of other industries and applications, including aerospace components, industrial equipment and machinery, farm equipment, heavy machinery, by way of non-limiting example.

Aluminum and its alloys are lightweight and are therefore desirable for use in fuel-efficient vehicles. One factor that may limit automotive applications of aluminum and its alloys is its thermal stability. At temperatures above about 200° C., certain material phases that maintain alloy strength can coarsen or dissolve, resulting in decreased performance. The use of zirconium in an aluminum alloy has the potential to improve the microstructure and mechanical properties of the alloy. Thus, there is a need for methods of making zirconium-containing aluminum alloys and methods of increasing the amount of zirconium in aluminum alloys.

In various aspects, the present disclosure provides a method of making an aluminum alloy that includes at least aluminum, zirconium, and copper. In certain variations, the present disclosure provides a method of increasing the amount of zirconium in solid solution in aluminum alloys. More specifically, certain methods according to the present disclosure add zirconium to an aluminum alloy melt by introducing a master alloy including a copper-zirconium compound that includes greater than or equal to about 41 mole % to less than or equal to about 67 mole % zirconium. The copper-zirconium compound, e.g., CuZr, of the master alloy is unstable below about 715° C., and therefore it decomposes and makes zirconium available to be dissolved in solid solution within the aluminum alloy. In various methods, the use of a master alloy including a copper-zirconium compound in aluminum increases the zirconium content in the alloy because the aluminum-zirconium system is peritectic and therefore it has a higher solubility for zirconium in the solid state than in the liquid state.

Referring to FIG. 1, a partial binary aluminum-zirconium phase diagram is shown. The x-axis 10 represents molar percent zirconium and the y-axis 12 represents temperature in ° C. A liquidus 14 represents a phase boundary between a liquid phase 16 and a liquid+solid phase 18. In this aluminum-zirconium system, the liquid phase 16 includes aluminum with zirconium dissolved therein. The liquid+solid phase 18 includes both liquid, which is aluminum with zirconium dissolved therein, and $ZrAl_3$. A solidus 20 represents a phase boundary between the liquid+solid phase 18 and a first solid phase 22. The first solid phase 22 includes solid aluminum having zirconium dissolved therein, and $ZrAl_3$. A solvus 24 represents a phase boundary between a second solid phase 26 that is substantially homogeneous and the first solid phase 22. The second solid phase 26 includes aluminum with zirconium dissolved therein.

The aluminum-zirconium system is peritectic. In a peritectic system, two phases, one of them liquid, transform into a new solid phase upon cooling. Here, the liquid phase 16 and the liquid+solid phase 18 (i.e., liquid+$ZrAl_3$) can be cooled to form the second solid phase 26 (i.e., (Al)). Another feature of a peritectic system is that the zirconium solute has a higher solubility in the solid phase aluminum than in the liquid phase aluminum. At the peritectic temperature of 680.8° C., the liquid solubility 28 of zirconium in aluminum is about 0.033 atomic % (i.e., 0.08% by mass) and the solid solubility 30 is about 0.083 atomic % (i.e., 0.2% by mass). Thus, at the peritectic temperature, the solid solubility 30 is greater than the liquid solubility 28.

Zirconium can be difficult to dissolve in aluminum. In one example, waffle plates formed from a master alloy including aluminum and $ZrAl_3$ at about 25% zirconium by mass (the "master alloy comprising aluminum and zirconium") may be added to an aluminum melt to create an aluminum alloy containing zirconium. Creating the aluminum alloy containing zirconium in this manner can be challenging because of $ZrAl_3$'s high density and melting temperature.

$ZrAl_3$ has a relatively high density and stability compared to a relatively low density of the aluminum melt. For example, at a temperature of about 600° C., the density of $ZrAl_3$ is greater than or equal to about 1.6 to less than or equal to 1.8 times that of the aluminum melt. The relatively high density of $ZrAl_3$ can cause it to sink to the bottom of the melt, even with constant stirring. The settling of $ZrAl_3$ at the bottom of the melt is problematic because the aluminum melt may quickly reach its zirconium solubility limit in a bottom region of bath of the furnace where the $ZrAl_3$ is located. Meanwhile, a top region of the bath of the furnace away from the $ZrAl_3$ may include little to no dissolved $ZrAl_3$. Thus, the overall composition of the aluminum melt may include zirconium in an amount far less than the liquid solubility limit.

Another challenge in using the master alloy comprising aluminum and zirconium to introduce and dissolve zirconium in aluminum is that $ZrAl_3$ has a high melting temperature compared to the temperature of the aluminum melt. The melting temperature of $ZrAl_3$ is 1580° C. The $ZrAl_3$ melting temperature is much higher compared to aluminum alloy melts, which may be in a range of greater than or equal to about 580° C. to less than or equal to about 800° C. Thus, the high temperatures required to melt $ZrAl_3$ can present an additional challenge in dissolving zirconium in aluminum by way of the master alloy comprising aluminum and zirconium.

To compensate for the above challenges, zirconium may be added to a melt in great excess. However, even when the zirconium is added in excess, the final alloy composition may be limited by zirconium's solubility in aluminum. More particularly, the final alloy composition may be limited by zirconium's liquid solubility in aluminum. In various aspects, the present disclosure provides an aluminum alloy containing zirconium and methods of making the aluminum alloy containing zirconium. In certain variations, the aluminum-containing zirconium alloys of the present disclosure may include increased zirconium content compared to other zirconium-containing aluminum alloys formed from the master alloy introduction or other similar techniques.

The methods according to certain aspects of the present disclosure can produce aluminum alloys having advantageous high temperature properties. Specifically, the methods may more than double the amount of zirconium available to form precipitate structures, decrease precipitate size, and increase precipitate density. The fine, dense precipitates improve material properties of the aluminum alloy containing zirconium by inhibiting recrystallization, in both cast and wrought alloys, and pinning grain and subgrain boundaries. Furthermore, the zirconium may inhibit the growth of precipitate structures such as a θ (theta) phase, an S phase a Q phase, a β (beta) phase, and other phases that may be present depending on the alloy composition.

Figure 2:
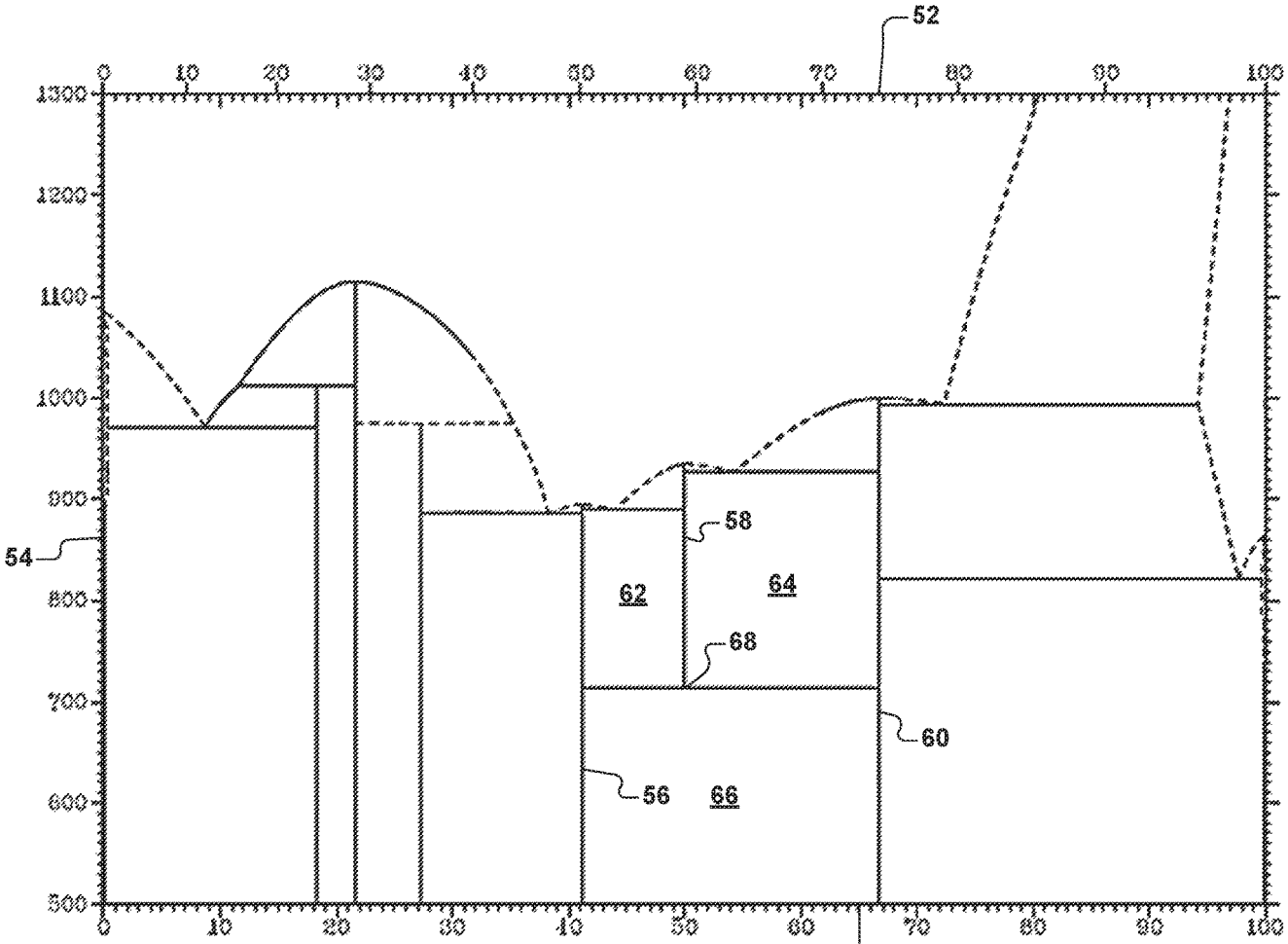
FIG. 2 is a binary phase diagram of a copper-zirconium system.

Referring now to FIG. 2, an exemplary binary phase diagram is shown that is believed to be representative of a copper-zirconium system. A first x-axis 50 represents atomic percent of zirconium in copper. A second x-axis 52 represents mass percent of zirconium in copper. A y-axis 54 represents temperature in ° C. In a region of interest, a first phase boundary 56 corresponds to a $Cu_{10}Zr_7$ intermetallic. A second phase boundary 58 corresponds to a CuZr intermetallic. A third phase boundary 60 corresponds to a $CuZr_2$ intermetallic. The first and second phase boundaries 56, 58 define a $Cu_{10}Zr_7$+CuZr solid phase 62. The second and third phase boundaries 58, 60 define a CuZr+$CuZr_2$ solid phase 64. At temperatures less than or equal to 715° C., the first and third phase boundaries 56, 60 define a $Cu_{10}Zr_7$+$CuZr_2$ solid phase 66.

As shown at 68, at a temperature of about 715° C. and a molar composition of greater than or equal to about 41% zirconium to less than or equal to about 67% zirconium, the CuZr intermetallic becomes unstable. Thus, the CuZr intermetallic decomposes as it is cooled below 715° C. In a pure copper-zirconium system, CuZr undergoes a phase change reaction to decompose into $Cu_{10}Zr_7$ and $CuZr_2$. However, when the CuZr is surrounded by an aluminum matrix/environment in accordance with certain aspects of the present disclosure, at least some zirconium resulting from this decomposition can be advantageously dissolved in the aluminum rather than forming the $Cu_{10}Zr_7$ and $CuZr_2$ intermetallics.

In other examples, the copper-zirconium compound may be a different copper-zirconium compound (e.g., $Cu_5Zr_8$) or a combination of copper-zirconium compounds (e.g., CuZr+$Cu_5Zr_8$), having a molar composition of greater than or equal to about 41% zirconium to less than or equal to about 67% zirconium. Similar to the CuZr of FIG. 2, the copper-zirconium compound becomes unstable or decomposes at temperatures less than or equal to about 715° C. Other suitable copper-zirconium compounds that decompose at similar temperatures of less than or equal to about 715° C. may likewise be used in the methods according to certain aspects of the present disclosure.

A method according to certain aspects of the present disclosure relies on the instability of the copper-zirconium intermetallic below about 715° C. to introduce zirconium into an aluminum alloy melt to create an aluminum alloy containing zirconium. In certain variations, the aluminum alloy containing zirconium includes an aluminum casting alloy selected from the group consisting of: 2xx series aluminum alloys (e.g., two hundred series aluminum alloys), 3xx series aluminum alloys (e.g., three hundred series aluminum alloys), 4xx series aluminum alloys (e.g., four hundred series aluminum alloys), 5xx series aluminum alloys (e.g., five hundred series aluminum alloys), 7xx series aluminum alloys (e.g., seven hundred series aluminum alloys), and combinations thereof. In certain other variations, the aluminum alloy containing zirconium melt includes a wrought aluminum alloy selected from the group consisting of: 2xxx series aluminum alloys (e.g., two thousand series aluminum alloys), 3xxx series aluminum alloys (e.g., three thousand series aluminum alloys), 4xxx series aluminum alloys (e.g., four thousand series aluminum alloys), 5xxx series aluminum alloys (e.g., five thousand series aluminum alloys), 6xxx series aluminum alloys (e.g., six thousand series aluminum alloys), 8xxx series aluminum alloys (e.g., eight thousand series aluminum alloys), and combinations thereof.

Figure 3:
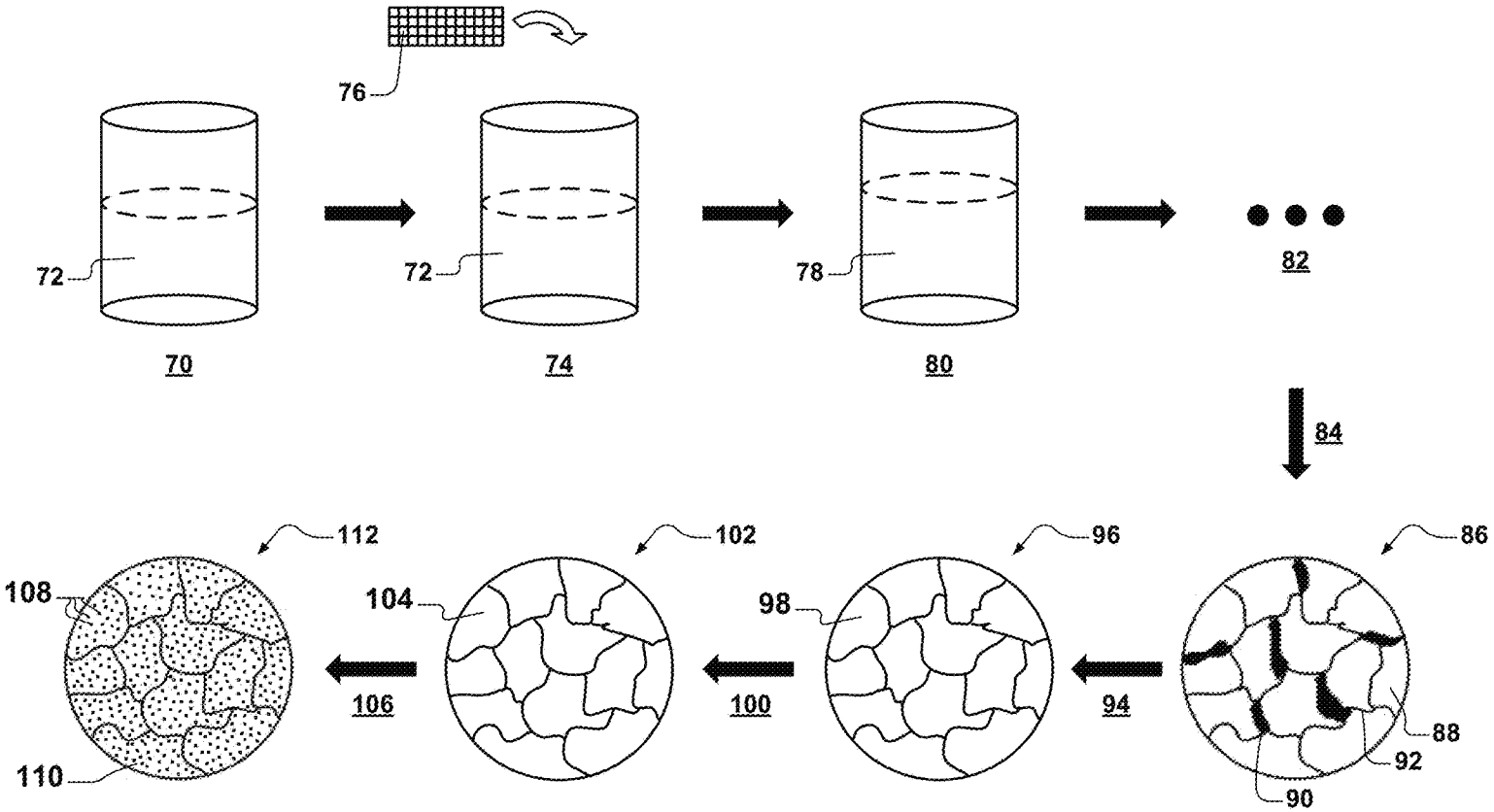
FIG. 3 is a schematic of a method of making an aluminum alloy containing zirconium according to certain aspects of the present disclosure.

Referring now to FIG. 3, at 70, an aluminum melt 72 having a first composition is brought to a first temperature or pouring temperature of greater than or equal to about 580° C. to less than or equal to about 800° C., optionally greater than or equal to 650° C. to less than or equal to about 780° C. The first composition may be an aluminum alloy that includes other components, such as copper, manganese, silicon, magnesium, zinc, and combinations thereof, by way of non-limiting example. At 74, a master alloy that includes a copper-zirconium compound 76 is added to the aluminum melt 72 to form a third composition 78, shown at 80. The copper-zirconium compound has a second composition of greater than or equal to about 41 mole % zirconium to less than or equal to about 67 mole % zirconium. When the copper-zirconium compound of the master alloy 76 is in a solid state above 715° C., it includes an intermetallic, such as CuZr or $Cu_5Zr_8$, or a metallic glass, by way of non-limiting example.

At 82, the third composition 78 may be cast or otherwise formed. At 84, the third composition is cooled to a second temperature below a solidus of the system and thus solidified to form a solid material 86. The solidification may occur at a rate of greater than or equal to 0.01° C./second to less than or equal to about 100° C./second, optionally greater than or equal to about 0.01° C. to less than or equal to about 50° C./second, optionally greater than or equal to about 0.01° C./second to less than or equal to about 20° C., optionally about 10° C./second. The second temperature must be below the solidus, which varies based on composition. In certain variations, the second temperature may be less than or equal to about 660° C., optionally less than or equal to about 420° C., and in certain variations, optionally less than or equal to about 200° C. so that the third composition is quenched. The copper-zirconium compound does not decompose during this step.

Precipitates may or may not form during cooling. For example, during the solidifying, in a pure copper-zirconium system, the copper zinc compound, like CuZr, can decompose into $CuZr_2$ and/or $Cu_{10}Zr_7$. However, in accordance with certain aspects of the present disclosure, the system is not a pure copper-zirconium system, but rather it includes at least copper, zirconium, and aluminum. Because the aluminum has solubility for zirconium, in certain variations, at least some of the zirconium from the unstable and decomposing CuZr or other decomposing copper zirconium species may be dissolved in the aluminum during the solidifying step. In some variations, large precipitates form as the material is cooled. For example, the solid material 86 may include aluminum grains 88 having precipitates 90 dispersed near grain boundaries 92. The precipitates 90 may be relatively large, having an average dimension of greater than or equal to about 5 μm to less than or equal to about 500 μm.

Large precipitates are less desirable than smaller precipitates because they are easily avoidable by dislocations and therefore result in alloys having decreased material properties. However, in certain other variations, no precipitates are formed during the cooling step. The formation and characteristics of precipitates is highly dependent on rate of cooling, fourth temperature, and composition.

The solid material 86 may undergo heat treatment at 94 to facilitate the formation of desirable precipitates to change the microstructure of the solid material 86. The heat treatment may include three steps: (1) solutionizing, (2) quenching, and (3) aging. Generally, a material is heated in the solutionizing step to dissolve a solute and form a solid solution. The solid solution is quenched by rapidly lowering its temperature to form a quenched solution that is oversaturated. The quenched solid solution is aged to form fine precipitates that enhance the material properties of the alloy.

Solutionizing involves raising the temperature of the solid material 86 to a fourth temperature and holding the solid material 86 at the fourth temperature to form a solid solution 96. Solutionizing may involve a phase change reaction. For example, prior to solutionizing, the solid material 86 may include an aluminum matrix or grains 88 having various precipitates 90 dispersed throughout. After solutionizing, the solid solution may include a substantially homogeneous aluminum matrix 98. Thus, the fourth temperature may be greater than or equal to the solvus of the system to less than or equal to the solidus of the system. The fourth temperature may be as close to the solidus as possible without exceeding the solidus, thereby maximizing the solubility of zirconium. In contrast, due to the peritectic reaction, if the fourth temperature exceeds the solidus temperature and liquid begins to form, the solubility of zirconium decreases.

In certain aspects, during solutionizing, the copper-zirconium compound decomposes. Decomposition may partially occur during solidifying and/or solutionizing or may occur exclusively within the solidifying step or solutionizing step, depending on the systems and temperatures used. As noted above, in a pure copper-zirconium system, the CuZr would decompose into $CuZr_2$ and/or $Cu_{10}Zr_7$. However, in accordance with various aspects of the present disclosure, the system is not a pure copper-zirconium system, but rather it includes at least copper, zirconium, and aluminum. Because the aluminum has solubility for zirconium, at least some of the zirconium from the unstable and decomposing CuZr may be dissolved in the aluminum. In some examples, some $Cu_{10}Zr_7$ and $CuZr_2$ may be formed and may also become unstable and further decompose, making zirconium available. The amount of the zirconium dissolved in the aluminum in the first material may be less than or equal to the solid peritectic composition. By way of non-limiting example, the solid peritectic composition may be greater than or equal to about 0.2% by mass percent.

At 100, the solid solution 96 is quenched, for example by water or forced air, to form a quenched solid solution 102. During quenching, the solid solution 96 is brought to a fifth temperature. For example, the solid solution 96 may be quenched at a rate of greater than or equal to about 10° C./second to less than or equal to about 100° C./second. The fifth temperature may be greater than or equal to about 20° C. to less than or equal to about 300° C., optionally greater than or equal to about 20° C. to less than or equal to about 160° C., by way of non-limiting example. During quenching, the dissolved zirconium is "locked" in solution because it does not have enough time to diffuse or migrate out. More specifically, because of the rapid cooling rate, the zirconium atoms do not have sufficient time to diffuse to nucleation sites and precipitates do not form as readily as when lower cooling rates are used. Thus, the quenched solid solution 102 includes an aluminum matrix 104 that is over-saturated with zirconium and is therefore unstable.

The quenched solid solution 102 is aged at 106. The aging process facilitates the formation of desirable precipitates 108 dispersed throughout an aluminum matrix 110 to form a high strength an aluminum alloy containing zirconium 112. The aging may be artificial or natural (i.e., performed at room temperature over a longer period of time than artificial aging). During artificial aging, the quenched solid solution 102 is brought to a sixth temperature that is higher than the fifth temperature. By way of non-limiting example, the sixth temperature may be greater than or equal to about 100° C. to less than or equal to about 350° C., optionally greater than or equal to about 160° C. to less than or equal to about 350° C., optionally about 200° C. Because the quenched solid solution 102 is unstable, aging causes zirconium to come out of solid solution and form precipitates 108. These precipitates may be complex compounds with other elements contained in the alloy. The sixth temperature is low enough that diffusion of the zirconium is relatively short and the fine precipitates 108 grow within the aluminum matrix 110 as opposed to forming at grain boundaries.

As described above, the heat treatment may be a T6 or T7 heat treatment including solutionizing, quenching, and aging. However, in other variations (not shown), the material may be quenched and then aged, without a solutionizing step (i.e., T5 heat treatment). In other variations, for wrought alloys, the solid material may go directly into a rolling process after casting at 82 that takes place at greater than or equal to about 300° C. to less than or equal to about 350° C. In still other variations, the wrought material may go through a cold rolling process at around 100° C. In some variations, wrought alloys are heat treated after rolling.

Returning to FIG. 3, the aluminum alloy containing zirconium includes at least aluminum, zirconium, and copper. In certain variations, the aluminum alloy containing zirconium 112 may include zirconium at compositions up to the peritectic solid solubility of the system. For example, the composition of the aluminum alloy containing zirconium 112 may be less than or equal to about 0.2% zirconium by mass. In certain variations, the zirconium content may optionally be greater than or equal to about 0.05% by mass to less than or equal to about 0.2% by mass of the aluminum alloy containing zirconium 112. The zirconium may present in the form of compounds of aluminum and zirconium, such as $ZrAl_3$ precipitates. In certain other variations, zirconium may be present in the aluminum at a higher composition than the solid solubility. For example, the aluminum alloy containing zirconium 112 may include up to about 5% zirconium by mass, for example, optionally less than or equal to about 1% by mass, optionally less than or equal to about 2% by mass, optionally less than or equal to about 3% by mass, optionally less than or equal to about 4% by mass, and in certain variations, less than or equal to about 5% zirconium by mass. In certain variations, the aluminum alloy containing zirconium 112 has an amount of greater than or equal to about 0.05% by mass zirconium to less than or equal to about 5% by mass zirconium. Higher concentrations of zirconium are possible because zirconium may form other precipitates in additional to or instead of $ZrAl_3$, such as $(AlSi)_3TiZr$, $Cu_{10}Zr_7$, and $CuZr_2$, by way of non-limiting example. In other examples, complex precipitates may form with other components from the aluminum melt 72 or the master alloy 76. Some zirconium may remain in solid solution.

In certain variations, the aluminum alloy containing zirconium 112 includes copper at greater than or equal to 0.05% by mass to less than or equal to about 10% by mass, optionally greater than or equal to about 0.5% by mass to less than or equal to about 3% by mass. The aluminum alloy containing zirconium 112 may include copper and zirconium in the above ranges and the balance aluminum. Thus, the aluminum alloy containing zirconium 112 may include a balance of aluminum, for example, at less than or equal to about 99.82% by mass of the alloy. In certain other variations, the aluminum alloy containing zirconium may include aluminum, copper, zirconium, and one or more other elements such as manganese, silicon, magnesium, and zinc, by way of non-limiting example.

The precipitates 108 may have a dimension of less than or equal to about 500 μm, optionally less than or equal to about 1 μm, optionally less than or equal to about 500 nm, optionally less than or equal to about 200 nm. The distribution of the fine precipitates 108 throughout the aluminum matrix 110 strengthens the aluminum alloy containing zirconium 112 by restricting dislocation or resisting the growth of other precipitate phases such as a θ (theta) phase, a Q phase, or a β (beta) phase, by way of non-limiting example. That is, the precipitates 108 pin the aluminum grains 110 so that they do not slip past one another during stress. The precipitates 108 are also advantageous in grain refinement and prevention of grain growth, particularly in wrought alloys. Aluminum alloys containing zirconium 112 according to certain aspects of the present disclosure have grains with an average dimension of less than or equal to about 10 cm, optionally less than or equal to about 1 cm, optionally less than or equal to about 1 mm, optionally less than or equal to about 500 μm, optionally less than or equal to about 200 μm, optionally less than or equal to about 100 μm, optionally less than or equal to about 10 μm.

Alloys formed by methods according to certain aspects of the present disclosure may be applicable to various casting processes for a variety of vehicle or automotive components. For example, aluminum alloys containing zirconium may be used for cylinder heads and blocks. Alloys formed by the methods according to certain aspects of the present disclosure may also be used for wrought products, such as extrusion billets, extruded rods, tubes, sheets, and forged materials, by way of non-limiting example.

While exemplary components are described above, it is understood that the inventive concepts in the present disclosure may also be applied to any structural component capable of being formed of a lightweight metal, including those used in vehicles, like automotive applications including, but not limited to, pillars, such as hinge pillars, panels, including structural panels, door panels, and door components, interior floors, floor pans, roofs, exterior surfaces, underbody shields, wheels, storage areas, including glove boxes, console boxes, trunks, trunk floors, truck beds, lamp pockets and other components, shock towers, shock tower cap, control arms and other suspension or drive train components, engine mount brackets, transmission mount brackets, alternator brackets, air conditioner compressor brackets, cowl plates, and the like. The aluminum alloys containing zirconium according to the present disclosure may likewise be used in non-automotive applications, such as buildings, windows, aircrafts, pumps, and other mechanical components, by way of non-limiting example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of making an aluminum alloy containing zirconium, the method comprising:

heating a first composition comprising aluminum to a first temperature of greater than or equal to about 580° C. to less than or equal to about 800° C.;

adding a second composition comprising a copper-zirconium intermetallic compound to the first composition to form a third composition, the copper-zirconium intermetallic compound of the second composition having a molar composition of greater than or equal to about 41% zirconium to less than or equal to about 67% zirconium and a balance of copper; and solidifying the third composition at a cooling rate of greater than or equal to about 0.1° C./second to less than or equal to about 100° C./second to a second temperature less than or equal to a solidus temperature;

decomposing the copper-zirconium intermetallic compound into copper and zirconium at a third temperature after the solidifying; and dissolving at least a portion of the zirconium from the decomposing in the aluminum to form a solid solution, thus forming the aluminum alloy.

2. The method of claim 1, wherein the copper-zirconium intermetallic compound comprises CuZr.

3. The method of claim 1, further comprising heat treating the third composition to create the aluminum alloy containing zirconium, wherein the heat treating facilitates formation of one or more precipitates as a distinct phase in the aluminum alloy containing zirconium.

4. The method of claim 3, wherein at least a portion of the one or more precipitates comprise compounds of zirconium (Zr) and aluminum (Al).

5. The method of claim 4, wherein the portion of the one or more precipitates defines a dimension of less than or equal to about 500 micron (μm).

6. The method of claim 5, wherein the portion of the one or more precipitates defines a dimension of less than or equal to about 500 nanometers (nm).

7. The method of claim 3, wherein the heat treating comprises:

heating the third composition to a fourth temperature of greater than or equal to a solvus temperature of the third composition to less than or equal to a solidus temperature of the third composition to form a solid solution;

quenching the solid solution to a fifth temperature of greater than or equal to about 20° C. to less than or equal to about 300° C. to form a quenched solid solution; and heating the quenched solid solution to a sixth temperature greater than the fifth temperature to create the aluminum alloy containing zirconium.

8. The method of claim 1, wherein the aluminum alloy containing zirconium comprises a casting aluminum alloy selected from the group consisting of: 2xx series, 3xx series, 4xx series, 5xx series, 7xx series, and combinations thereof.

9. The method of claim 1, wherein the aluminum alloy containing zirconium comprises a wrought aluminum alloy selected from the group consisting of: 2xxx series, 3xxx series, 4xxx series, 5xxx series, 6xxx series, 8xxx series, and combinations thereof.

10. The method of claim 1, wherein the aluminum alloy containing zirconium comprises:

copper at greater than or equal to about 0.1% by mass to less than or equal to about 10% by mass; and zirconium at greater than or equal to about 0.05% by mass to less than or equal to about 5% by mass.

11. The method of claim 10, wherein the aluminum alloy containing zirconium comprises copper at greater than or equal to about 0.5% by mass to less than or equal to about 3% by mass.

12. The method of claim 1, wherein the aluminum alloy containing zirconium comprises zirconium at greater than or equal to a liquid peritectic composition of zirconium in the aluminum alloy containing zirconium.

13. The method of claim 12, wherein an average grain size is greater than or equal to about 100 microns (μm) to less than or equal to about 500 microns (μm).

14. The method of claim 1, wherein the aluminum alloy containing zirconium comprises an average grain size of greater than or equal to about 10 microns (μm) to less than or equal to about 10 centimeter (cm).

* * * * *